US009404368B2

(12) United States Patent
Wunderer

(10) Patent No.: US 9,404,368 B2
(45) Date of Patent: Aug. 2, 2016

(54) BLADE CASCADE AND TURBOMACHINE

(71) Applicant: MTU Aero Engines GmbH, Munich (DE)

(72) Inventor: Roland Wunderer, Unterschleissheim (DE)

(73) Assignee: MTU Aero Engines GmbH, Munich (DE)

( * ) Notice: Subject to any disclaimer, the term of this patent is extended or adjusted under 35 U.S.C. 154(b) by 694 days.

(21) Appl. No.: 13/756,721

(22) Filed: Feb. 1, 2013

(65) Prior Publication Data

US 2013/0202444 A1 Aug. 8, 2013

(30) Foreign Application Priority Data

Feb. 2, 2012 (EP) ..... 12153623

(51) Int. Cl.

| | |
|---|---|
| ***F01D 5/14*** | (2006.01) |
| ***F01D 5/12*** | (2006.01) |
| ***F04D 29/18*** | (2006.01) |
| ***F04D 29/24*** | (2006.01) |
| ***F04D 29/30*** | (2006.01) |
| ***F04D 29/32*** | (2006.01) |
| ***F04D 29/44*** | (2006.01) |
| ***F04D 29/46*** | (2006.01) |
| ***F04D 29/54*** | (2006.01) |
| ***F04D 29/66*** | (2006.01) |

(Continued)

(52) U.S. Cl.

CPC *F01D 5/12* (2013.01); *F01D 5/141* (2013.01); *F01D 9/041* (2013.01); *F04D 29/181* (2013.01); *F04D 29/245* (2013.01); *F04D 29/30* (2013.01); *F04D 29/327* (2013.01); *F04D 29/4213* (2013.01); *F04D 29/444* (2013.01); *F04D 29/448* (2013.01); *F04D 29/462* (2013.01); *F04D 29/466* (2013.01); *F04D 29/542* (2013.01); *F04D 29/544* (2013.01); *F04D 29/666* (2013.01); *F05D 2250/51* (2013.01); *F05D 2260/961* (2013.01)

(58) Field of Classification Search

CPC ..... F01D 5/141; F04D 29/544; F04D 29/181; F04D 29/245; F04D 29/327; F04D 29/462; F04D 29/666; F04D 26/444; F04D 29/448; F04D 9/466; F05D 2260/961

USPC ..... 415/192, 194, 195; 416/175, 203

See application file for complete search history.

(56) References Cited

U.S. PATENT DOCUMENTS

| | | | | |
|---|---|---|---|---|
| 3,169,747 | A * | 2/1965 | Seymour | 415/195 |
| 3,861,822 | A * | 1/1975 | Wanger | 415/147 |
| 8,540,490 | B2 * | 9/2013 | Ramakrishnan et al. | 416/203 |

(Continued)

FOREIGN PATENT DOCUMENTS

| | | |
|---|---|---|
| DE | 10 2008 049 358 | 4/2010 |
| EP | 1 508 669 | 2/2005 |

(Continued)

*Primary Examiner* — Dwayne J White
*Assistant Examiner* — Juan G Flores
(74) *Attorney, Agent, or Firm* — Davidson, Davidson & Kappel, LLC

(57) ABSTRACT

A blade cascade for a turbomachine having a plurality of blades arranged next to one another in the peripheral direction, at least two blades having a variation for generating an asymmetric outflow in the rear area, as well as a turbomachine having an asymmetric blade cascade, which is connected upstream from another blade cascade, are disclosed.

8 Claims, 4 Drawing Sheets

(51) Int. Cl.
*F01D 9/04* (2006.01)
*F04D 29/42* (2006.01)

(56) References Cited

U.S. PATENT DOCUMENTS

| | | | | |
|---|---|---|---|---|
| 9,091,174 | B2 * | 7/2015 | Bagnall | F01D 5/141 |
| 2003/0123975 | A1 | 7/2003 | Horng | |
| 2004/0187475 | A1 | 9/2004 | Usab et al. | |
| 2009/0162198 | A1 | 6/2009 | Ogino et al. | |
| 2011/0164967 | A1 | 7/2011 | Elorza Gomez | |

FOREIGN PATENT DOCUMENTS

| | | | | |
|---|---|---|---|---|
| GB | 2 046 849 | | 11/1980 | |
| GB | 2046849 | A * | 11/1980 | F01D 9/02 |
| GB | 2 402 978 | | 12/2004 | |
| GB | 2475140 | | 5/2011 | |

* cited by examiner

BLADE CASCADE AND TURBOMACHINE

This claims the benefit of European Patent Application EP 12153623.9, filed Feb. 2, 2012 and hereby incorporated by reference herein.

The present invention relates to a blade cascade for a turbomachine as well as a turbomachine.

BACKGROUND

In turbomachines, in particular in compressors and hydraulic pumps but also in turbines, instable flow states and greatly increased losses result during partial and overload operations. On the one hand, the instable flow states result in strong pressure fluctuations which may damage the blade structures. On the other hand, the flow may completely collapse in the compressors and hydraulic pumps in a throttled state. This limits the operating range of the turbomachine and may result in damage to the turbomachine when admissible limits are exceeded.

The instable flow state is primarily caused by the flow separation on the individual blades in the cascade system. To suppress the separation, a temporarily changed inflow may lead toward the blades. In one known measure, the blade affected by the separation oscillates around an axis of suspension. In another measure, oscillating blades are located in the inflow of the blades affected by the separation, whereby a harmonic, oscillating inflow is generated toward the blades. One example is an oscillating system of initial stationary blades. Another measure provides that a fluid is introduced through blow-in locations distributed over the periphery, which has a flow angle and/or a flow momentum deviating from the main flow, and thereby the inflow of the blades affected by the separation is locally changed. The disadvantage of these active measures is, however, that, on the one hand, energy, which must be taken from the overall process, is needed to influence the flow, whereby the overall efficiency is reduced. On the other hand, to implement these measures, complex constructive and regulative changes are necessary which result in an increased development effort, an increased susceptibility to errors, and an increased weight of the machine.

Furthermore, passive measures are known in which the blades of a blade cascade are profiled differently and/or are arranged asymmetrically in the blade cascade. DE 10 2008 049 358 A1 thus proposes to profile the blades of a compressor inlet guide baffle in such a way that a symmetric outflow from the blade cascade takes place in the case of an asymmetric inflow. For this purpose, the blades each have a changed front blade area. In GB 2 046 849 B1, a stationary blade arrangement having an asymmetric arrangement of stationary blades is shown whose rear edges are located on a line viewed in the peripheral direction and thus in identical axial position. EP 1 508 669 A1 shows a measure in which the blades of an initial guide baffle are profiled differently to take into account an asymmetric incident flow of a ring of initial stationary blades.

SUMMARY OF THE INVENTION

It is an object of the present invention to provide a blade cascade for a turbomachine which eliminates the above-mentioned disadvantages and increases the operating range of turbomachines compared to the known measures. Furthermore, it is an object of the present invention to provide a turbomachine having an increased operating range.

The present invention provides a blade cascade for a turbomachine having a plurality of blades which are arranged next to one another in the peripheral direction and of which at least two adjacent blades have different rear edge angles.

Due to the at least two different rear edge angles, the blade cascade is asymmetric in the peripheral direction, an asymmetric outflow taking place due to the variation in the rear blade area and thereby an inflow asymmetric in the peripheral direction with regard to a flow angle and flow moment being generated toward a downstream blade cascade affected by the separation. Viewed in the flow direction, the separation behavior in the blade cascade, which follows the asymmetric blade cascade, is suppressed thereby. The approach according to the present invention allows the operating range, in which a turbomachine may be operated, to be expanded and thus a reliable operation to be ensured even during partial and overload operations. Furthermore, the flow losses are reduced due to the asymmetric blade cascade according to the present invention and the efficiency is thus increased. The integration of the blade cascade into a turbomachine may take place without additional installations and with the aid of minor constructive measures. This allows the blade cascade to be used in already designed turbomachines without the need for redesigning the turbomachines. The asymmetric arrangement according to the present invention may be used in compressors or hydraulic pumps and in turbines as well as in machines through which a gaseous as well as a fluid medium flows. The blade cascade may, in addition, have an axial design, a radial design, or a mixed diagonal design.

In one exemplary embodiment, the blades are staggered differently in the peripheral direction across their entire height with regard to their preceding blade, so that the blades also have different front edge angles. The front edge angle is, however, changed by the same absolute value as the rear edge angle in this case. This exemplary embodiment allows the use of uniform or identical blades.

In one alternative exemplary embodiment, the blades are staggered differently in the peripheral direction across a part of their height with regard to their preceding blade. In this exemplary embodiment, each of the blades has at least two profile areas which are located one after another viewed in the transverse direction of the blades and which are twisted toward one another. Each of the blades thus has at least two different blade angle portions. One blade angle portion of the non-restaggered area is identical for all blades. One blade angle portion of the restaggered area varies among the blades and may increase or decrease, whereby each of the blades in this area has one changed rear edge angle and one front edge angle changed by the same absolute value.

In another exemplary embodiment, the blades are profiled differently in the peripheral direction across their entire height with regard to their preceding blade. In this exemplary embodiment, the blades are identically staggered with regard to their front edges and thus have identical front edge angles. However, the rear edge angles of the blades vary. For example, the blades have differently curved rear edge areas starting from a certain identical chord length.

In another exemplary embodiment, the blades are profiled differently in the peripheral direction only across a part of their height with regard to their preceding blade. This may, for example, be a local deformation of an outer area of the rear edge, viewed in the transverse direction of the blades, the orientation of the outer area in the peripheral direction being changed across multiple blades from an orientation in the direction of rotation to an opposite direction, for example.

In addition to the preceding exemplary embodiments, the blade cascade may cooperate with an adjusting device, so that the blades are adjustable in the peripheral direction to different degrees.

Particularly good effects may be achieved when the arrangements of the blades in the peripheral direction, named above as an example, are continued periodically multiple times.

One preferred turbomachine has a symmetric blade cascade and an upstream asymmetric blade cascade according to the present invention which moves in the peripheral direction in relation to the symmetric blade cascade.

Such a turbomachine has an enlarged operating range and a greater efficiency than conventional turbomachines. The turbomachine may be a compressor, a hydraulic pump, or a turbine. An arbitrary fluid or gaseous medium may in addition flow through the turbomachine.

The turbomachine may have an adjusting device which staggers the blades to different degrees and which allows both the formation of a symmetric blade cascade and the formation of an asymmetric blade cascade. Ideally, the adjusting device allows each blade to be controlled individually, whereby the highest flexibility possible is achieved with regard to the stagger. Alternatively, however, predefined symmetries and asymmetries may be set, which considerably simplifies the setting of the particular blade cascade.

The asymmetric blade cascade may be designed as a stator cascade and as a rotor cascade. When the blade cascade according to the present invention is designed as a stator cascade, it may have stationary blades or it may cooperate with an adjusting device for adjusting the blades.

BRIEF DESCRIPTION OF THE DRAWINGS

In the following, preferred exemplary embodiments of the present invention are elucidated in greater detail with reference to the schematic illustrations.

DETAILED DESCRIPTION

According to the present invention, the blades in a blade cascade of a turbomachine are to be attached in such a way that in the peripheral direction an asymmetric outflow from the blade cascade takes place with regard to the flow angle and flow speed, and thus an asymmetric inflow takes place in the relative system of a downstream blade cascade. In one preferred exemplary embodiment, the downstream blade cascade is symmetric. The asymmetric outflow is generated in that in the peripheral direction two or more adjacent blades have different rear edge angles. The blade cascade according to the present invention may be used in compressors or hydraulic pumps and in turbines as well as in machines through which gaseous or fluid medium flows.

Figure 4:
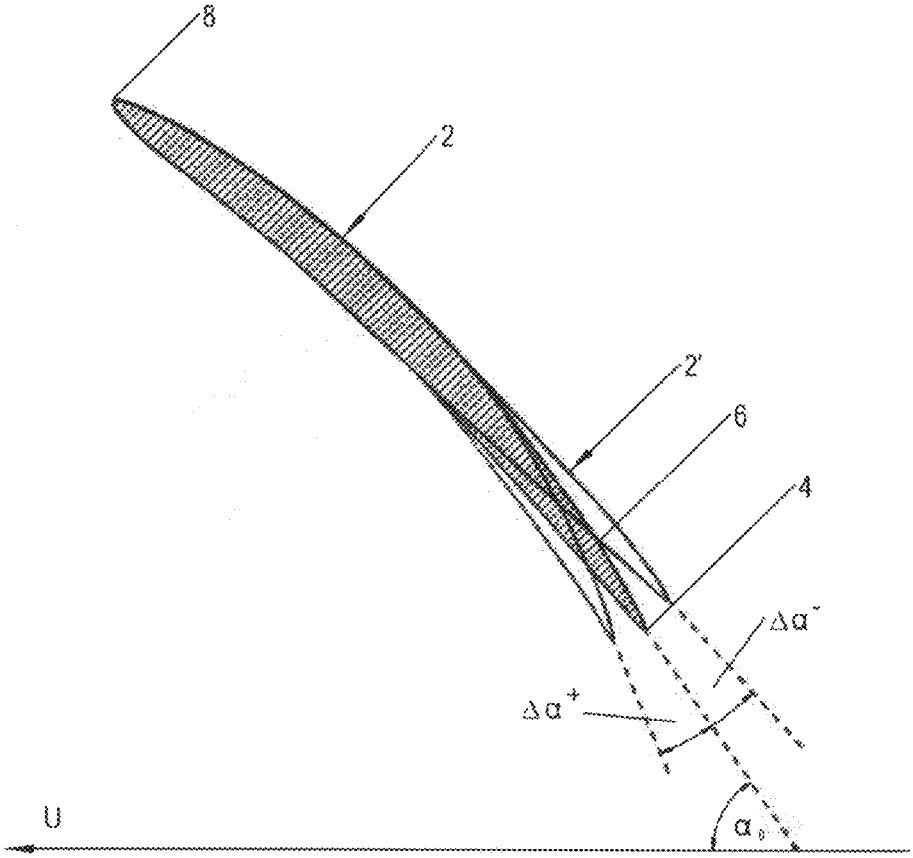
FIG. 4 shows a sectional illustration of a third exemplary embodiment of a blade of a blade cascade according to the present invention and exemplary profile changes in the rear edge area.

The rear edge angle is understood as an angle between a tangent of the camber line in the area of the rear edge and an axis in the peripheral direction (see FIG. 4, angle $\alpha$). On the one hand, rear edge angle $\alpha$ is a function of the blade profile in the rear blade area. On the other hand, rear edge angle $\alpha$ is a function of the stagger of the particular blade in the blade cascade and thus of the blade angle. The blade angle or stagger angle is understood as an angle between the chord and the axis in the peripheral direction (see FIG. 2, angle $\beta$). The transverse direction of the blades is understood as an orientation of the blade between a rotor-side blade root and a blade tip. In axial compressors, the blade direction is equal to the radial direction. An extension of the blade in the transverse direction of the blades is understood as blade height across all designs: axial, radial, or diagonal.

The implementation of the asymmetry may take place through multiple measures which are explained in the following based on the figures. Preferred measures are a restagger across the entire blade height (FIGS. 1 and 2), a restagger across a part of the blade height (also FIG. 2), a changed profile across a part of the blade height (FIGS. 3 and 4), and a changed profile across the entire blade height (also FIG. 4).

Figure 1:
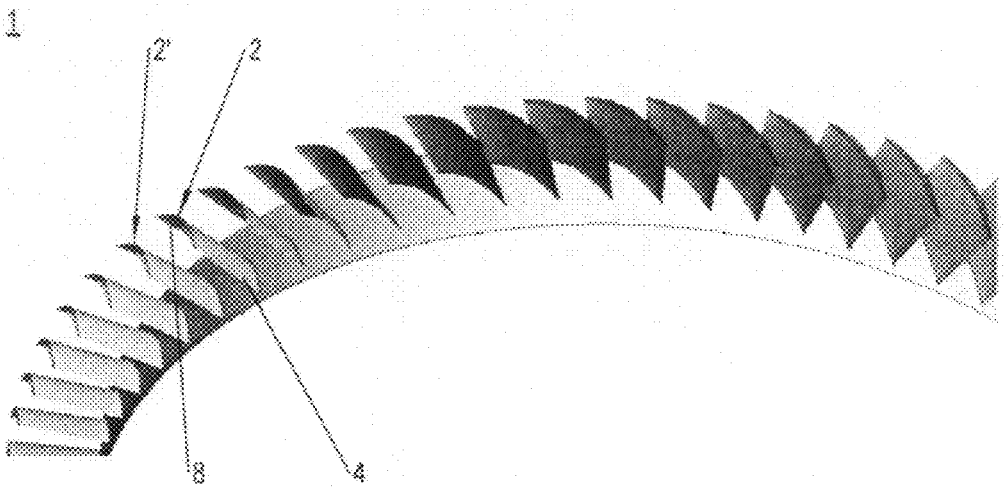
FIG. 1 shows a section of a first exemplary embodiment of a blade cascade according to the present invention.
Figure 2:
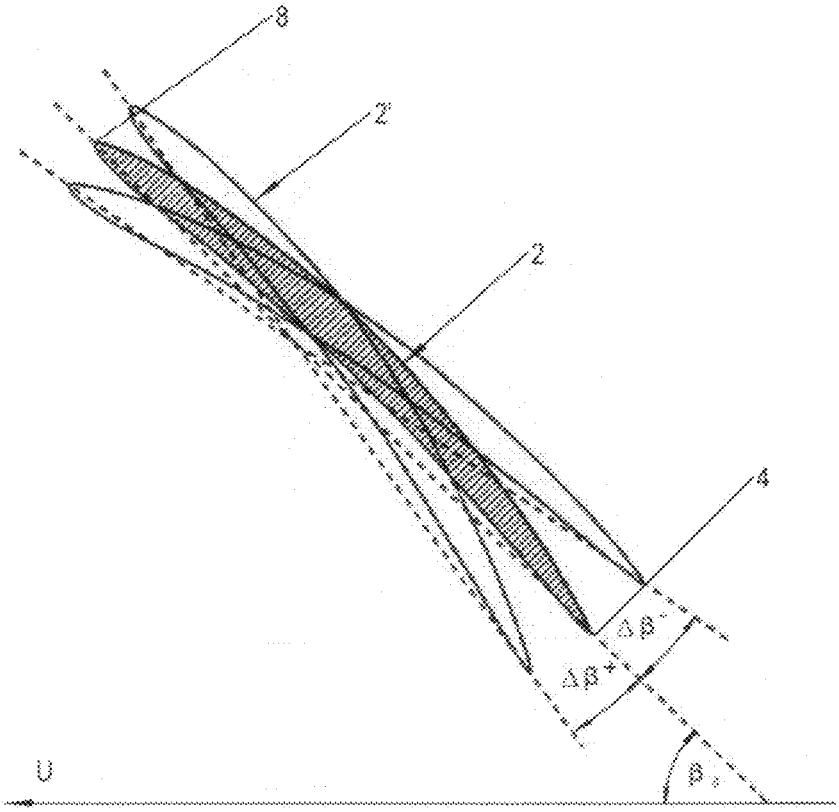
FIG. 2 shows a sectional illustration of a blade and exemplary restaggers.

FIGS. 1 and 2 show a restagger across the entire blade height in a compressor stator having an axial design. Since FIG. 2 is a sectional illustration, the sectional illustration may also show a restagger across a part of the blade height. In the following, a restagger across the entire blade height is, however, explained as an example based on FIGS. 1 and 2. For the sake of clarity, only blade angle $\beta$ is illustrated in FIG. 2. An asymmetric blade cascade 1 according to the present invention has a plurality of blades 2 arranged next to one another in the peripheral direction. Blade cascade 1 is, for example, a part of a compressor stator having an axial design. Blades 2 have a uniform profile and are staggered differently in the peripheral direction across their entire height with regard to their preceding blade 2'. In this way, blade angle $\beta$ varies with regard to preceding blade 2' starting from a blade angle $\beta_0$ which is increased $\Delta\beta+$ or reduced $\Delta\beta-$. By changing blade angle $\beta$, the position of their rear edges 4 in the peripheral direction changes so that identically profiled adjacent blades 2 demonstrate a different outflow behavior. In addition, rear edges 4 of blades 2 are no longer in line viewed in the peripheral direction due to the adjustment, but are in different axial positions, whereby the outflow behavior is additionally changed. Similarly to rear edge angle $\alpha$, the position of their front edges 8 and their front edge angles changes due to the restagger across the entire height. The front edge angle is understood as an angle between a tangent of the camber line in the area of front edge 8 and the axis in the peripheral direction (not illustrated).

Figure 3:
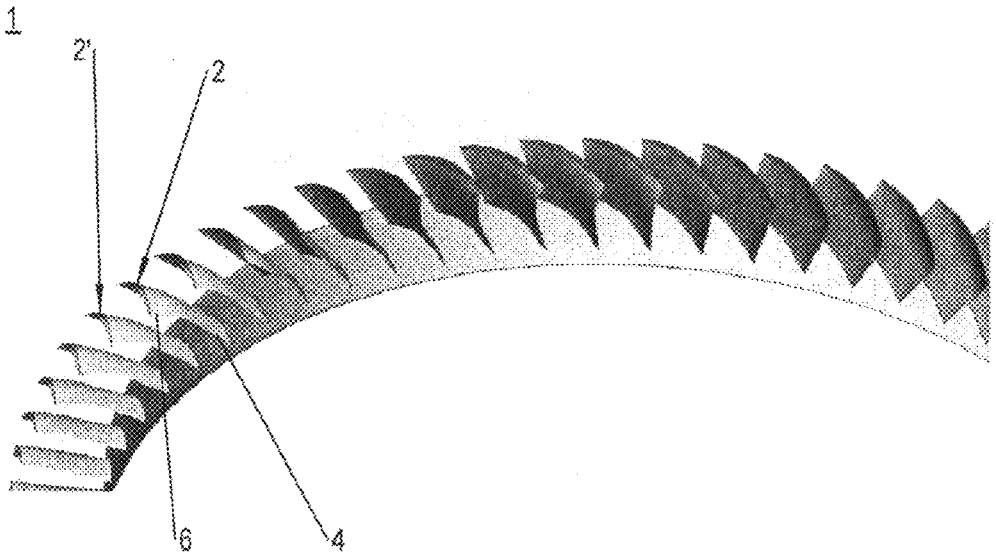
FIG. 3 shows a section of a second exemplary embodiment of a blade cascade according to the present invention.

FIG. 3 shows a changed profile across a part of the blade height in a compressor stator having an axial design. Shown blade cascade 1 forms, for example, a part of a compressor stator having an axial design. In the shown exemplary embodiment, blades 2 are profiled differently in outer area 6 of their rear edges 4 viewed in the transverse direction of the blades. Here, area 6 changes suddenly from an orientation in the direction of rotation to an orientation in the opposite direction, whereby rear edge angle $\alpha$ of blades 2 is increased $\Delta\alpha+$ or reduced $\Delta\alpha-$ with regard to preceding blade 2' starting from a rear edge angle $\alpha_0$. In blades 2, rear edge angle $\alpha$ is cut at a uniform position in the transverse direction of the blades, it being preferably cut in the area of the maximum profile change. Blade angle β is preferably also cut in the area of the maximum profile change. Likewise, each blade 2 has a constant blade angle portion $\beta_{const}$ and a varying blade angle portion $\beta_{var}$ with regard to a flow path section as a result of the local profiling. Each blade 2 has a constant rear edge angle portion $\alpha_{const}$ and a varying rear edge angle portion $\alpha_{var}$ with regard to a flow path section. Angle portions $\alpha_{const}$, $\beta_{const}$ are identical and constant for all blades 2 in the unchanged profile area. In the area of the profile change, angle portions $\alpha_{var}$, $\beta_{var}$ vary, however, between a blade 2 and a preceding blade 2'. For the sake of clarity, angle portions $\alpha_{const}$, $\beta_{const}$, $\alpha_{var}$, $\beta_{var}$ are not shown in FIG. 3.

FIG. 4 shows a changed profile across the entire blade height. Since FIG. 4 is a sectional illustration, the sectional illustration may also show a changed profile across a part of the blade height. In the following, a changed profile across the entire blade height is, however, explained as an example based on FIG. 4. In the shown exemplary embodiment, blades 2 have differently curved rear edge areas 6 starting from a certain identical chord length, whereby rear edge angle α of blades 2 is increased Δα+ or reduced Δα− with regard to preceding blade 2' starting from a rear edge angle $\alpha_0$. Due to the different curvature on the rear-edge side, adjacent blades 2 each have different profiles. The area of their front edges 8 is, however, identically profiled so that blades 2 thus have identical front edge angles.

To vary the asymmetric blade arrangements, blade cascades 1 according to the preceding exemplary embodiments may cooperate with an adjusting device 100 shown schematically in FIG. 3 which allows individual blades 2 to be restaggered to different degrees.

Figure 5:
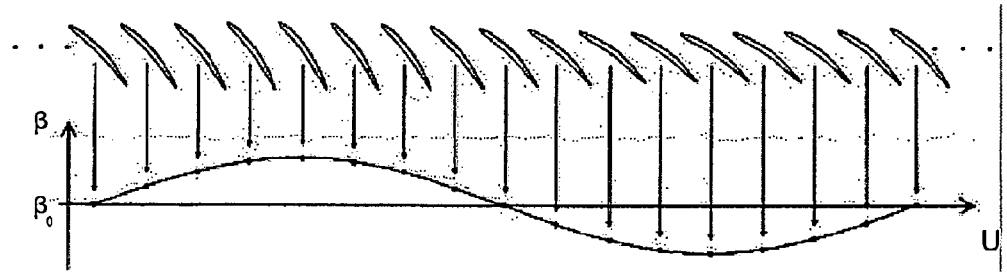
FIG. 5 shows a conformable representation of an exemplary flow path section of the blade cascade according to the present invention.

As shown in the conformable representation of a flow path section according to FIG. 5, the asymmetric arrangement of blades 2 in the peripheral direction is preferably continued periodically multiple times. The flow path section shown here was positioned in the transverse direction of the blades at the outer area of blades 2. FIG. 5 illustrates an asymmetric blade arrangement according to the present invention with reference to the exemplary embodiment of the restagger across the entire blade height (see FIGS. 1 and 2). The blade cascade arrangement is, in particular, selected in such a way that a harmonic and periodic angle distribution is present. An arbitrary arrangement or profile formation of blades 2 may take place within one period. The minimum number of blades 2 per period is two. The relevant variable for the arrangement or profile formation of a blade 2 is in this case their outflow angle of blade 2. The outflow angle is essentially a function of rear edge angle α and thus of blade angle β and the profile geometry; this is why rear edge angle α is used as a variable to describe the asymmetric blade cascade arrangement, as shown in FIG. 6.

Figure 6:
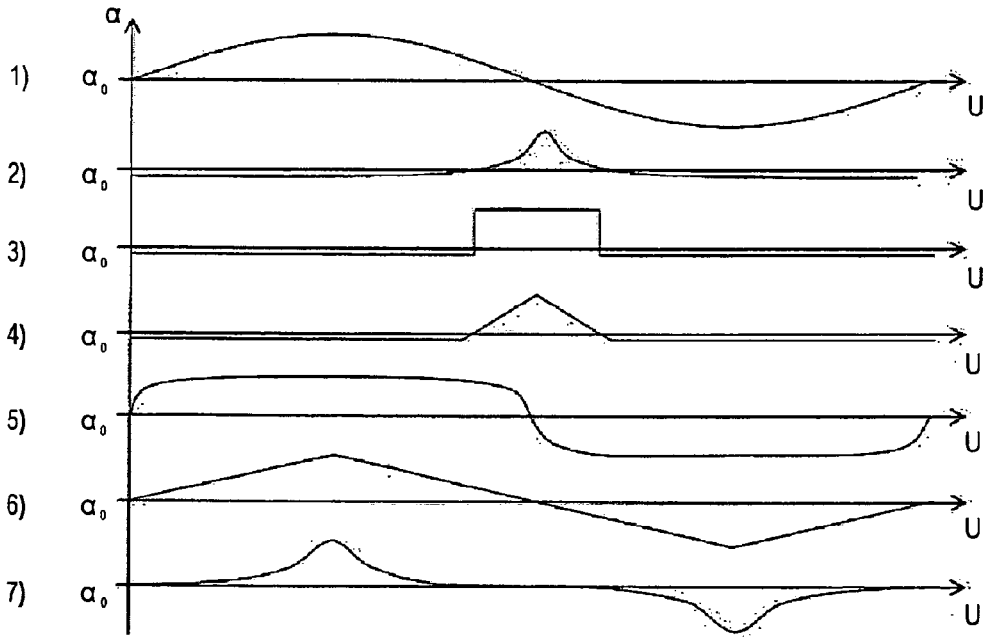
FIG. 6 shows examples of asymmetric and periodic arrangements of the blades of the blade cascade according to the present invention.

Seven examples for an asymmetric arrangement of blades 2 in relation to rear edge angle α are shown in FIG. 6, exemplary embodiments 1, 2, 3, and 4 being preferred.

The number of blades 2, which are to be attached within one period, is ascertained with the aid of the following equations which are equivalent to one another. Equation 1:

$$A' = \frac{N_{S1} \cdot n \cdot l_{S2} \cdot \sin\beta_{S2}}{\sigma' \cdot c_{ax-S2} \cdot 60\ \text{sec}}$$

Equation 2:

$$A'' = \frac{N_{S1} \cdot l_{S2}}{\sigma'' \cdot r_{S2}}$$

Figure 7:
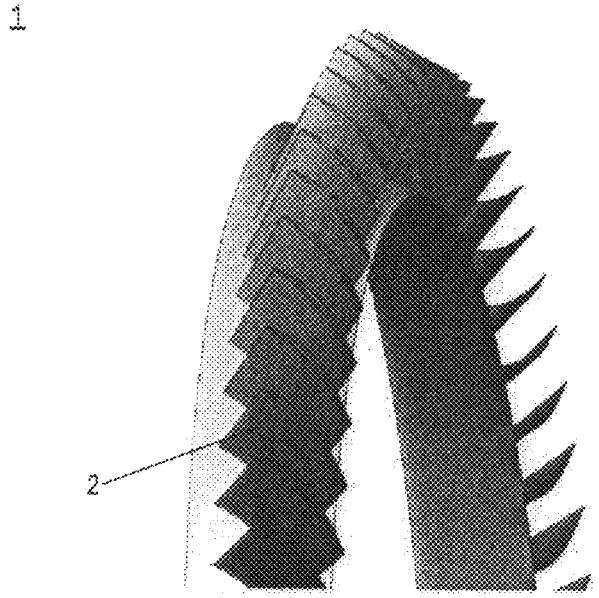
FIG. 7 shows a section of an exemplary compressor stator having a diagonal design.

Here, the following definitions apply, blade cascade 1 being the asymmetric blade cascade and a second blade cascade 22, shown merely schematically in FIG. 7, being the blade cascade which follows the asymmetric blade cascade in the flow direction.

A': number of blades per period according to equation 1

A": number of blades per period according to equation 2 n [1/min]: rotational speed of the machine $N_{S1}$: number of blades of blade cascade 1

$r_{s2}$ [m]: characteristic radius of the blades in the second blade cascade 2. This is the radius at which a separation, which is suppressed by blade cascade 1 according to the present invention, takes place in the second blade cascade. Preferably, $r_{s2}$ approximately corresponds to the outer radius of the blades in the second blade cascade.

$l_{s2}$ [m]: blade length at $r_{s2}$ in the second blade cascade.

$\beta_{s2}$ [°]: blade angle with regard to the peripheral direction at $r_{s2}$ in the second blade cascade.

$c_{ax-s2}$ [m/s]: axial speed of the flow at $r_{s2}$ upstream from the second blade cascade.

σ': blade coefficient for equation 1

σ": blade coefficient for equation 2

Asymmetric blade cascade 1 according to the present invention may be used in principle for the following value range:

σ'=[0.25 . . . 1.15]

σ"=[0.55 . . . 7.25]

Asymmetric blade cascade 1 is preferably used for the following value range:

σ'=[0.65 . . . 0.75]

σ"=[1.4 . . . 4.7]

The maximum value difference for the arrangement or profile formation of blades 2 is maximally 20° within one period. For an optimal implementation, the angle difference is maximally 10°.

Figure 8:
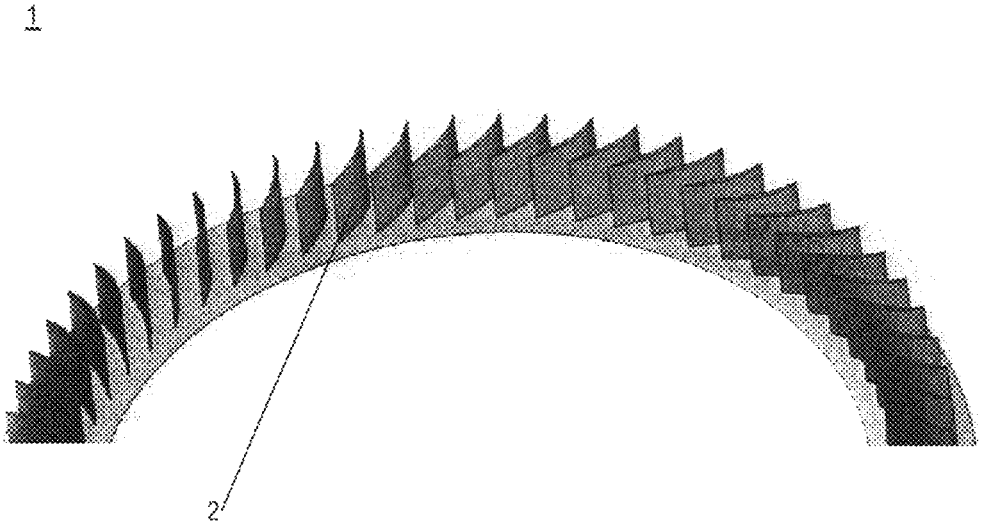
FIG. 8 shows a section of an exemplary compressor stator having a radial design.

To illustrate that the restagger or profile change according to the present invention is also used in compressors having diagonal and radial designs, reference is made to FIGS. 7 and 8. FIG. 7 shows a section of a compressor stator having a diagonal design, and FIG. 8 shows a section of a compressor stator having a radial design. The blades are provided with reference numeral 2, as an example. The present invention may, of course, also be implemented on turbines.

A blade cascade for a turbomachine having a plurality of blades arranged next to one another in the peripheral direction, at least two blades having a variation for generating an asymmetric outflow in the rear area, as well as a turbomachine having an asymmetric blade cascade, which is connected upstream from another blade cascade, are disclosed.

LIST OF REFERENCE NUMERALS

1 blade cascade
2 blade
2' adjacent blade
4 rear edge
6 area
8 front edge
22 downstream symmetric blade cascade
100 adjusting device
U peripheral direction
α rear edge angle β blade angle
Δα change of the rear edge angle
Δβ change of the blade angle

What is claimed is:

1. A turbomachine comprising:

a symmetric blade cascade; and an upstream asymmetric blade cascade having a plurality of blades arranged next to one another in the peripheral direction, at least two adjacent blades of the plurality of blades having different rear edge angles, the symmetric blade cascade and the asymmetric blade cascade moving in the peripheral direction relative to each other;

wherein each of the plurality of blades has a constant rear edge angle portion and a varying rear edge angle portion starting from a certain identical chord length, the varying rear edge angle portion of a first blade of the plurality of blades varying with respect to the rear edge portion of a preceding blade of the plurality of blades, the constant rear edge angle portion of the plurality of blades being identical.

2. The turbomachine as recited in claim 1 wherein the blades are staggered differently across a part of their height.

3. The turbomachine as recited in claim 1 wherein the blades are profiled differently across a part of their height.

4. The turbomachine as recited in claim 1 wherein the blades are adjustable to different degrees.

5. The turbomachine as recited in claim 1 wherein an arrangement of the blades in the peripheral direction is continued periodically multiple times.

6. The turbomachine as recited in claim 1 further comprising an adjusting device for staggering the blades to different degrees.

7. The turbomachine as recited in claim 1 wherein the asymmetric blade cascade is a stator cascade.

8. The turbomachine as recited in claim 1 wherein the asymmetric blade cascade is a rotor cascade.

* * * * *